US012421810B2

(12) United States Patent
Cayeux

(10) Patent No.: US 12,421,810 B2
(45) Date of Patent: Sep. 23, 2025

(54) DAMPING DRILL STRING VIBRATIONS

(71) Applicant: Norce Innovation AS, Stavanger (NO)

(72) Inventor: Eric Cayeux, Sandnes (NO)

(73) Assignee: Norce Innovation AS, Stavanger (NO)

( * ) Notice: Subject to any disclaimer, the term of this patent is extended or adjusted under 35 U.S.C. 154(b) by 0 days.

(21) Appl. No.: 18/716,817

(22) PCT Filed: Dec. 5, 2022

(86) PCT No.: PCT/NO2022/050279
§ 371 (c)(1),
(2) Date: Jun. 5, 2024

(87) PCT Pub. No.: WO2023/106926
PCT Pub. Date: Jun. 15, 2023

(65) Prior Publication Data

US 2025/0034957 A1 Jan. 30, 2025

(30) Foreign Application Priority Data

Dec. 7, 2021 (NO) ..... 20211466

(51) Int. Cl.
*E21B 17/07* (2006.01)
*E21B 17/02* (2006.01)

(52) U.S. Cl.
CPC ..... *E21B 17/073* (2013.01); *E21B 17/028* (2013.01)

(58) Field of Classification Search
CPC ... E21B 17/073; E21B 17/028; E21B 17/1064
See application file for complete search history.

(56) References Cited

U.S. PATENT DOCUMENTS 3,837,758 A * 9/1974 Streicher ..... B23B 31/08 408/143
7,306,058 B2 12/2007 Cargill et al.
(Continued)

FOREIGN PATENT DOCUMENTS

CN 105840128 8/2016
CN 106050161 A 10/2016
(Continued)

OTHER PUBLICATIONS

Search Report for Corresponding Norwegian Application No. 20211466, dated Jun. 27, 2022.
(Continued)

*Primary Examiner* — Shane Bomar
(74) *Attorney, Agent, or Firm* — Andrus Intellectual Property Law, LLP

(57) ABSTRACT

A device for damping vibrations of a rotary drill string in motion in a wellbore, a related method, drill string and drill string sub or section, where at least one component of motion of the drill string is communicated to the device, and brake means counter the vibrations, resisting the motion in dependence upon the speed of motion. The device may have an outer sleeve arranged on an inner, tubular body which is rotatably arranged within the outer sleeve. Roller wheels support the sleeve on the wellbore wall and facilitate longitudinal movement of the device and prevent rotational slipping of the outer sleeve relative to the wall upon rotating the tubular body and drill string. One brake part of the brake means on the outer sleeve and another on the tubular body operate to resist rotational vibration components.

20 Claims, 6 Drawing Sheets

(56) References Cited

U.S. PATENT DOCUMENTS

| | | | | |
|---|---|---|---|---|
| 8,087,476 | B2 | 1/2012 | Wassell | |
| 10,830,916 | B2 | 11/2020 | Lau | |
| 12,012,843 | B2 * | 6/2024 | Church | H02K 7/116 |
| 2007/0289778 | A1 | 12/2007 | Watkins et al. | |
| 2010/0101781 | A1 * | 4/2010 | Scholz | E21B 17/0283 166/66.5 |
| 2012/0085581 | A1 | 4/2012 | Wassell et al. | |
| 2012/0205122 | A1 * | 8/2012 | Peter | E21B 34/085 166/321 |
| 2018/0340415 | A1 * | 11/2018 | Chin | E21B 41/0085 |
| 2020/0018124 | A1 * | 1/2020 | Hohl | E21B 17/1042 |
| 2020/0018377 | A1 | 1/2020 | Hohl | |

FOREIGN PATENT DOCUMENTS

| | | | |
|---|---|---|---|
| CN | 105909203 | | 8/2018 |
| CN | 112593868 | A | 4/2021 |
| JP | 2017198310 | | 4/2020 |
| RU | 2708532 | | 12/2019 |
| WO | 2021050335 | A1 | 3/2021 |

OTHER PUBLICATIONS

International Search Report and the Written Opinion for Corresponding International Application No. PCT/NO2022/050279, dated Mar. 13, 2023.

Response to the Written Opinion for Corresponding International Application No. PCT/NO2022/050279, dated Nov. 2, 2023.

Second Written Opinion for Corresponding International Application No. PCT/NO2022/050279, dated Jan. 4, 2024.

Response to the Second Written Opinion for Corresponding International Application No. PCT/NO2022/050279, dated Feb. 9, 2024.

International Preliminary Report on Patentability for Corresponding International Application No. PCT/NO2022/050279, dated Jan. 3, 2024.

V. Dagestad; M. Mykkeltvedt; K. Eide; N. Reimers "First Field Results for Extended-Reach CT-Drilling Tool." Paper presented at the SPE/ICoTA Coiled Tubing Conference & Exhibition, The Woodlands, Texas, USA, Apr. 2006.

Sicco Dwars "Recent Advances in Soft Torque Rotary Systems." Paper presented at the SPE/IADC Drilling Conference and Exhibition, London, England, UK, Mar. 2015.

Mark Hutchinson "Automated Downhole Vibration Damping." Paper presented at the SPE/IADC Middle East Drilling Technology Conference & Exhibition, Dubai, UAE, Oct. 2013.

Aage Kyllingstad "A Comparison of Stick-Slip Mitigation Tools." Paper presented at the SPE/IADC Drilling Conference and Exhibition, The Hague, The Netherlands, Mar. 2017.

Roman J. Shor "The effect of well path, tortuosity and drillstring design on the transmission of axial and torsional vibrations from the bit and mitigation control strategies" 2016.

Weatherford "LoTORQ Mechanical Friction-and Wear-Reudction Centralizer System" 2002-2013, weatherford.com.

* cited by examiner

DAMPING DRILL STRING VIBRATIONS

CROSS-REFERENCE TO RELATED APPLICATIONS

This application is the U.S. national stage application of International Application No. PCT/NO2022/050279, filed Dec. 5, 2022, which international application was published on Jun. 15, 2023, as WO 2023/106926 in the English language. The International Application claims priority to Norwegian patent application No. 20211466, filed Dec. 7, 2021. The international application and Norwegian application are both incorporated herein by reference, in their entirety.

FIELD

The present invention relates to drill strings, and in particular, it relates to a device for damping drill string vibrations of a rotary drill string.

BACKGROUND

Drill stem vibrations during wellbore drilling operations are generally a significant problem and a source of drilling malfunctions. Vibrations can lead to failures of sensitive parts in the BHA like measurement while drilling tools, rotary steerable systems, positive displacement motors, but also to prematurely wear tool joints with the possible consequence of a pipe washout or even twist-offs. Repetitive shocks of the drill string with the formation rocks can destabilize the open hole leading to hole collapse. Also, unstable conditions at the bit deteriorate the rate of penetration and can lead to bit damage.

Most current solutions that address drill string vibrations presuppose that the source of excitation is at the bit-rock interaction. Those existing solutions utilize one single vibration attenuation mechanism either inside the BHA like an anti-stall tool or at the top drive as with stick-slip mitigation systems that control the top-drive speed or torque to damp out torsional oscillations. However, drill string vibrations have many more sources of excitations such as mechanical friction between the drill string and the borehole in the axial and rotational directions, grinding of cuttings by the tool joints, the complex interactions between hydraulic generated forces and mechanical friction and centrifugal, Euler and Coriolis accelerations on the rotating pipes. All these additional sources of vibrations are distributed along the string. Some of those vibrations may propagate along the full length of drill string like torsional oscillations, while others may just concern a portion of the string such as during whirling conditions.

The present inventor has found that typical single-location vibration damping solutions only deal with certain vibration scenarios. At least one aim of the invention is to obviate or at least mitigate one or more drawbacks of prior art.

Example prior art includes U.S. Patent Application Publication Number US 2020/0018377 A1.

SUMMARY

According to a first aspect of the invention, there is provided a device for damping vibrations of a rotary drill string in motion in a wellbore, the device comprising: brake means to counter the vibrations, by way of resisting the motion in dependence upon the speed of motion, wherein the brake means comprises at least one pair of brake parts; an inner, tubular body extending longitudinally between first and second ends, the first end being configured with a threaded section to screw connect the tubular body to a first adjacent section of a drill string, and the second end being configured with a threaded section to screw connect to a second adjacent section of the drill string, the tubular body thus being configured to rotate with the drill string; an outer sleeve supported on the inner, tubular body, the tubular body being arranged rotatably within the outer sleeve; and at least one roller wheel for supporting the sleeve on a wall of the wellbore, the roller wheel being configured to facilitate longitudinal movement of the device along the wall and prevent rotational slipping of the outer sleeve relative to the wall upon rotation of the drill string; wherein the outer sleeve is associated with the one brake part of the pair, and the inner, tubular body is associated with the other brake part of the pair, the one brake part being movable relative to the other brake part upon rotation of the tubular body relative to the outer sleeve; wherein the brake parts are operable, through the movement of the one brake part relative to the other brake part upon rotation of the tubular body relative to the outer sleeve with the drill string, to produce a braking force in dependence upon the speed of rotation of the inner, tubular body relative to the outer sleeve for braking or resisting rotational vibrations. The device is an example of a device for damping vibrations of a rotary drill string in motion in a wellbore, at least one component of the motion being communicated to the device, the device comprising brake means to counter the vibrations, by way of resisting the motion in dependence upon the speed of motion. The device may have any one or more further features as set out in any of the dependent claims 2 to 12 of the claims appended hereto, or anywhere else herein.

In examples of this device, it can be appreciated that the inner tubular body is arranged within the outer sleeve so as to be rotatable relative to the outer sleeve with the rotation of the drill string. Further, the inner tubular body can be considered one of the tubulars in the succession of end-to-end connected drill string tubulars making up the drill string to which torque is transmitted by the drive means (e.g., rotary table on the drill platform or downhole motor) to perform the drilling. The inner tubular body can be a tubular sub or a drill pipe of the drill string. The inner tubular body by being one of the drill string tubulars communicating torque in use can thus rotate within the outer sleeve with the rpm rate of the drill string with vibrations superimposed.

Upon rotating the drill string and/or the tubular body in use, the one brake part is movable relative to the other brake part in accordance with and corresponding to the rotation of the inner tubular body relative to the outer sleeve. This can be for example by the one brake part being affixed to or disposed on or otherwise coupled to the sleeve and the other affixed or provided on or otherwise coupled to inner tubular body. The movement between brake parts can thus produce the braking force. The brake parts can for example be arranged so that the one rotates with respect to the other brake part with the rotation of the tubular body relative to the sleeve, and so that it does so with substantially the same speed and sense of rotation as the rotating inner tubular body relative to the sleeve for resisting or braking rotational vibrations in the rotational movement of the tubular body relative to the outer sleeve.

Through the brake means and/or brake parts during rotation of the string, the brake means and/or brake parts produce the braking force for resisting or braking rotational vibration components of the rotational movement between the tubular body and the outer sleeve, in dependence upon the rotational movement of the tubular body relative to the outer sleeve.

Embodiments in accordance with this first aspect may be advantageous in that the device can be supported on the wall by the roller wheel, which can allow the device to rollably move with low friction along the wellbore wall during drilling whilst the sleeve is prevented from slippage, e.g. the sleeve does not slip, rotationally relative to the wellbore wall. This can provide significant freedom of movement of the device and inner tubular body axially to maintain weight on bit against the formation being drilled, whilst the inner tubular body as part of the string at the same time can freely rotate within and with respect to the sleeve. The brake parts can then operate to resist and brake rotational vibration components in the rotational movement between the inner tubular body and the sleeve. Through use of the sleeve and roller, frictional components axially and rotationally can thus be separated, permitting more effective removal of the rotational vibrations and significant weight on bit engagement of the formation for effective drilling performance.

According to a second aspect of the invention, there is provided a device for damping vibrations of a rotary drill string in motion in a wellbore, at least one component of the motion being communicated to the device, the device comprising brake means to counter the vibrations, by way of resisting the motion in dependence upon the speed of motion.

Through operating the brake means with dependency upon speed, variations in speed can produce changes in resistance applied from the brake means, so that one can obtain braking effects responding to the vibrations as and when they occur. For example, a greater braking effect may be applied in the event of a change in speed associated with a vibration to reduce or suppress the vibration.

Preferably, the brake means is operable passively by or in response to the drill string being in motion. This can be beneficial in that the vibrations can be countered autonomously, using mechanical parts, without requiring activation, without requiring control, electrics, hydraulics, or the like. Typically, the brake means is operable to produce a component of braking force for resisting the motion in dependence upon the speed of motion. The braking force may thus be communicated to the drill string from the brake means.

Typically, the device is configured to be disposed downhole on the drill string. The device may comprise a drill string section for connecting the device to the drill string. The drill string section may comprise a tubular body having end connectors with threaded sections for screw connecting the body to adjacent sections of the drill string.

The brake means can be or comprise for example a magnetic brake or a fluid brake. The magnetic brake or fluid brake may be operable to produce a component of magnetic or fluid braking force, i.e. a magnetic or fluid resistance force.

The produced component of braking force may be dependent upon, e.g. proportional to or increase monotonically with, the magnitude of the speed of motion of the drill string. Thus, an increase in the speed of motion of the drill string may produce an increase in the component of force that may be produced from the brake means for resisting the motions of the string.

The motion of the drill string may comprise any of: a longitudinal component of movement; a rotational component of movement; a longitudinal vibration component; and a rotational vibration component.

The drill string in use in the wellbore may either or both: rotate in the wellbore; and advance longitudinally along the wellbore.

Typically, the brake means comprises at least one pair of brake parts, the one brake part of the pair being movable relative to the other brake part of the pair, to produce a component of braking force for resisting a component of relative movement between the brake parts, the relative movement obtained through operating the drill string. Further typically, the produced component of braking force is produced in dependence upon the speed of movement between the parts.

Typically, the brake parts of the pair are operationally coupled so that by movement of the one part relative to the other brake part the one brake part may operate to produce an effect upon the other brake part that may retard the relative movement therebetween.

The one or the other brake part may be subjected to magnetic resistance force during motion. The one or the other brake part may have eddy currents imparted from a magnetic field. The one brake part may be configured to produce a magnetic field, the other brake part may be arranged to be subjected to the magnetic field. The one brake part may comprise at least one magnet, the other brake part may comprise non-magnetic, conductive material.

Typically, the device further comprises an outer structure and an inner structure, the inner structure being arranged rotatably within the outer structure, the outer structure comprising the one brake part and the inner structure comprising the other part brake part, the parts being arranged for braking a rotational component of movement therebetween for braking a rotational component of movement of the device relative to the wellbore in use.

The inner structure may comprise a body connected to the string so as to be rotatable in use by rotational operation of the string. The body may typically comprise a first end and a second end configured to be coupled to adjacent sections of a drill string. The body may thus comprise or be a tubular body.

In some examples, the brake part of the inner structure may comprise a layer of non-magnetic, conductive material around the body, and the brake part of the outer structure may comprise at least one magnet for producing a magnetic field so that upon relative rotation of the inner structure relative to the outer structure, in use, eddy currents may be produced in the layer of non-magnetic, conductive material for braking a rotational component of movement between the inner and outer structure.

Conversely, in some examples, the brake part of the outer structure may comprise a non-magnetic, conductive material, and the brake part of the inner structure may comprise at least one magnet for producing a magnetic field so that upon relative rotation of the inner structure relative to the outer structure, in use, eddy currents may be produced in the layer of non-magnetic, conductive material for braking a rotational component of movement between the inner and outer structure.

In some examples, either or both of the brake parts may comprise a ring or sleeve or annular body.

Typically, the outer structure comprises an annular sleeve. The sleeve may be configured to bear against a wall of the wellbore during use.

Typically, the outer structure may include at least one roller wheel for supporting the outer structure on the wall of the wellbore for facilitating longitudinal movement and/or resisting rotational movement of the device with respect to the wellbore.

Typically, the outer structure is supported on the string for permitting rotation of the string with respect to the outer structure. The outer structure may be supported in bearing relationship upon bearings, e.g. thrust bearings.

The device may further comprise at least one pair of brake parts which may be arranged for braking or resisting a longitudinal component of movement of the device relative to the wellbore in use.

The device may further comprise an outer structure and an inner structure, the inner structure being arranged rotatably within the outer structure, and another pair of brake parts for braking or resisting a rotational component of movement between brake parts.

The pair of brake components for braking the longitudinal component and the pair of brake components for braking the rotational component may typically be operable to respond separately to longitudinal and rotational movement of the string along the wellbore. The brake parts for braking the longitudinal component may be disposed on the outer structure.

The outer structure may include at least one roller wheel which may be coupled to at least one of the brake parts so that the movement of the wheel on a wall of the wellbore in use longitudinally is communicated to produce movement between the parts of brake parts in dependence upon the movement of the string along the wellbore.

Either or both parts of the brake pair for braking or resisting the longitudinal movement along the wellbore may comprise a ring, body or sleeve which may be rotatable with respect to one another about a common axis and may be coupled to the roller wheel through a gear arrangement for translating rotational movement between the brake parts to permit longitudinal tracking of the roller wheel and vice versa in dependence upon the longitudinal movement of the drill string.

The features set out in relation to the device in accordance with second aspect also apply to the device in accordance the first aspect or any other aspect of the invention.

According to a third aspect of the invention, there is provided a device for damping vibrations of a rotary drill string, the device comprising at least one eddy current brake configured to be coupled to a downhole section of the drill string. The device of the third aspect may have one or more further features as set out in relation to the device of the first or second aspects of the invention.

According to a fourth aspect of the invention, there is provided a device for damping vibrations of a rotary drill string, the device comprising a passive brake configured to be coupled to a downhole section of the drill string, the brake being operable in dependence upon the speed of movement of the drill string to produce a force which opposes one or more components of vibration of the drill string. The device of the third aspect may have one or more further features as set out in relation to the device of the first, second or third aspects of the invention.

According to a fifth aspect of the invention, there is provided a rotary drill string including at least one device in accordance with any of the first to fourth aspects disposed on a downhole section of the drill string.

The drill string may include a plurality of devices disposed on the drill string at different downhole positions along the drill string, respective ones being a device for damping vibrations in accordance with any of the first to third aspects of the invention.

According to a sixth aspect of the invention, there is provided a method of drilling a borehole using a drill string in accordance with the fifth aspect of the invention.

According to a seventh aspect of the invention, there is provided a drill string sub comprising: a tubular body configured to be connected to an end of a drill pipe section of a rotary drill string; and at least one brake which is disposed upon the tubular body and which is passively operable in response to operating the drill string in the wellbore to produce a braking force component opposing at least one vibrational change in speed of movement of the drill string.

Any of the various aspects of the invention may have one or more further features as described in relation to any other aspect of the invention wherever described herein.

Embodiments of the invention may be further advantageous in various ways as will be apparent from throughout herein.

BRIEF DESCRIPTION OF THE DRAWINGS

There will now be described, by way of example only, embodiments of the invention with reference to the accompanying drawings, in which.

DETAILED DESCRIPTION OF THE DRAWINGS

Figure 1:
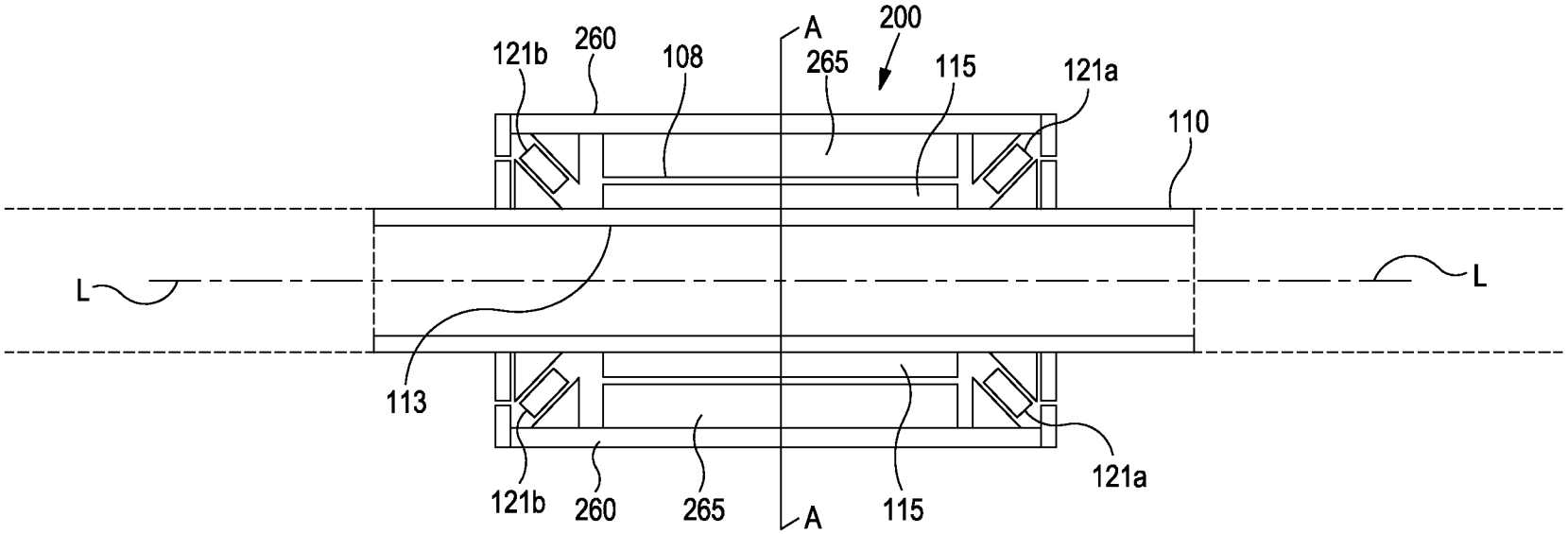
FIG. 1 is a sectional representation of a vibration damping device in accordance with an embodiment of the invention for damping rotational vibrations.

Turning first to FIG. 1, a vibration damping device 200 for coupling to a drill string is depicted. The device 200 has an outer structure comprising an outer sleeve 260 and an inner structure comprising a body in the form of a drill string tubular 110 arranged to be screw connected to adjacent sections of the drill string. The device also comprises brake means operable for resisting motions of the string in the wellbore in dependence upon the speed of motion.

The outer sleeve 260 is supported on the drill string tubular 110. The drill string tubular 110 comprises a tubular section 113 that is surrounded by the sleeve. The sleeve 260 is supported upon thrust bearings 121*a*, 121*b* which permit rotation of the drill string tubular 110 relative to the outer sleeve 260. The inner structure comprises a brake part in the form of a surrounding layer of non-magnetic, conductive material 115, which forms part of the tubular section 113 being rotatable as the tubular section of the drill string tubular 110 is rotated about the longitudinal axis of the drill string. The sleeve 260 comprises another brake part in the form of a magnet ring on an inside of the sleeve and which extends circumferentially around tubular section 113 of the drill string. The sleeve 260 is arranged so that a small clearance 108 is present between the layer of conductive material 115 and the magnet ring 265. A magnetic field is generated in the region within the magnet ring 265. By rotational movement of inner structure within the magnetic field upon rotation of the string, eddy currents arise in the non-magnetic, conductive material 115 so that a braking force is produced proportional to the rate of rotation to resist the rotation between inner and outer structures. In the event of rotational vibrations, which in effect produce small variations in rotation speed of the drill string, the eddy current braking force obtained as a result, being proportional to the speed variations of the vibrational movements, suppress or reduce the rotational vibration component in the motion.

Figure 2:
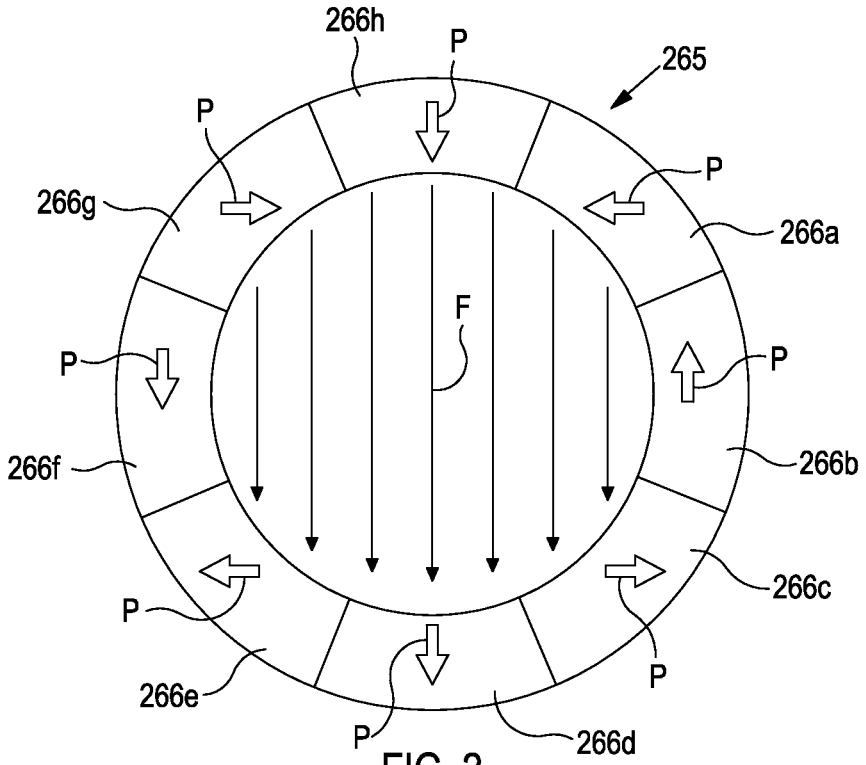
FIG. 2 is a representation of the magnet ring from the section line AA in FIG. 1, indicating the magnetic field generated by the magnet ring.
Figure 3:
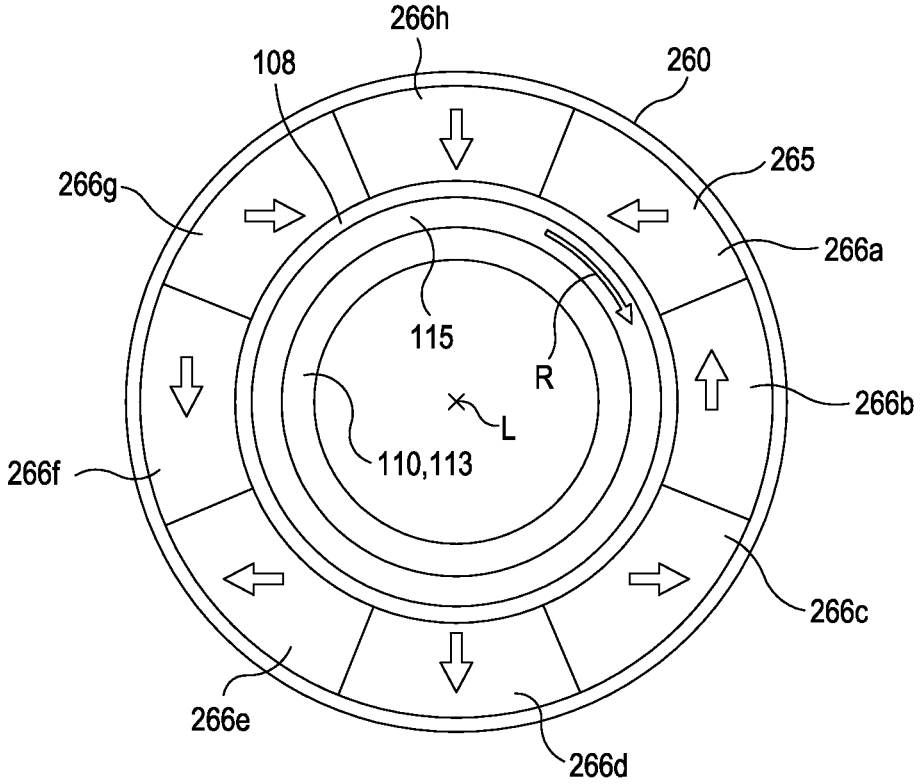
FIG. 3 is a representation of the outer sleeve and tubular section of the drill string tubular along the section line AA in FIG. 1 illustrating the movement of the tubular section within the magnetic field of the magnet ring.

The principle can be further understood with reference to FIGS. 2 and 3, where permanent magnets 266*a*-266*h* are arranged with poles in various directions as indicated by arrows P combining to produce a uniform magnetic field F in the area enclosed by the ring 265. The tubular section 113 is rotated as indicated by arrow R about the longitudinal axis L of the tubular. The rotation of the conductive layer 115 in the area of the magnetic field produces eddy currents in the conductive material of the layer 115 that resist the rotation and the resistance of the eddy currents varies according to the rate of rotation which in turn varies in response to vibrations, so that when the rate of rotation varies because of vibrations, the eddy currents generated give rise to magnetic braking and attenuation or reduction of the vibrations rotationally in the string. Solely using mechanical components, the vibration damping device conveniently provides damping and restrict vibrations in use, so that significantly improved performance of drilling can be obtained using the drill string with the vibration damping device.

Figure 4:
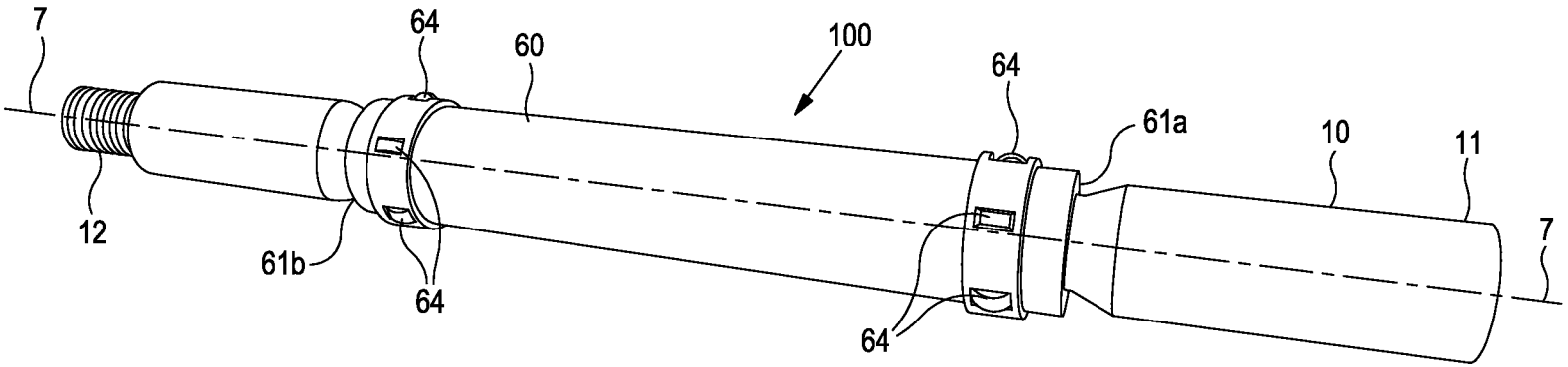
FIG. 4 is a perspective representation of a vibration damping device on a drill string tubular.
Figure 5:
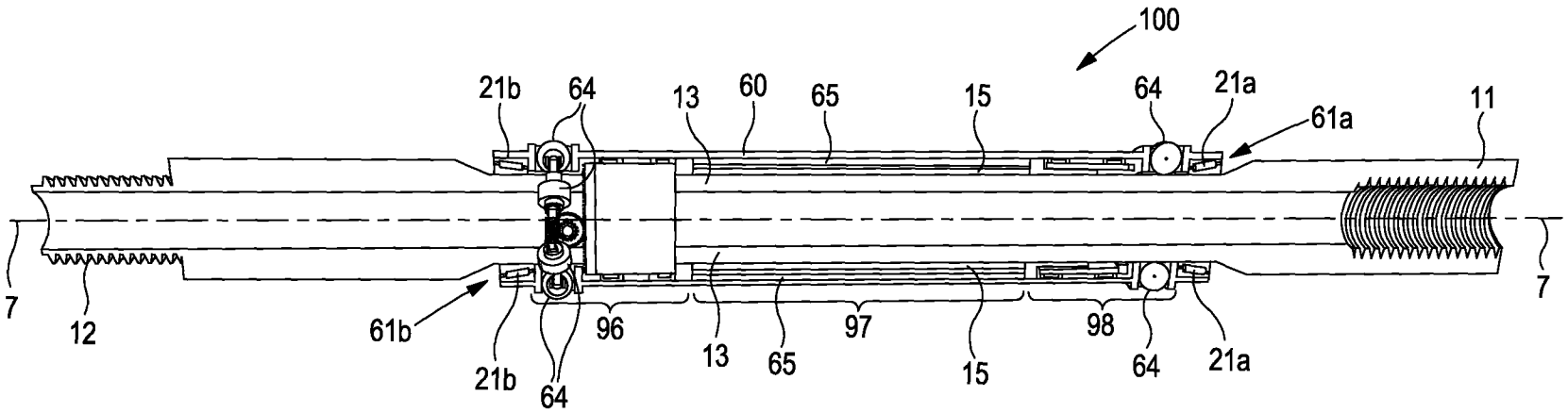
FIG. 5 is a sectional representation of the vibration damping device of FIG. 4.

Turning then to FIGS. 4 and 5, another vibration damping device 100 is arranged on a drill string tubular 10. The vibration damping device 100 is configured to damp or restrict, through eddy current braking, both rotational and longitudinal vibration components.

As can be seen, the drill string tubular 10 has a box end 11 and a pin end 12 for connecting the tubular 10 to adjacent tubulars of a drill string (not shown) for incorporating the tubular 10 into the drill string. The drill string tubular 10 is rotatable with the drill string about the longitudinal axis 7 of the string.

The vibration damping device 100 comprises an outer sleeve 60 that extends around the drill string tubular 10. The drill string tubular 10 has a body 13 that extends through the sleeve between the box end 11 and the pin end 12. The sleeve 60 is elongate and extends longitudinally between first and second ends 61*a*, 61*b*.

Figure 6:
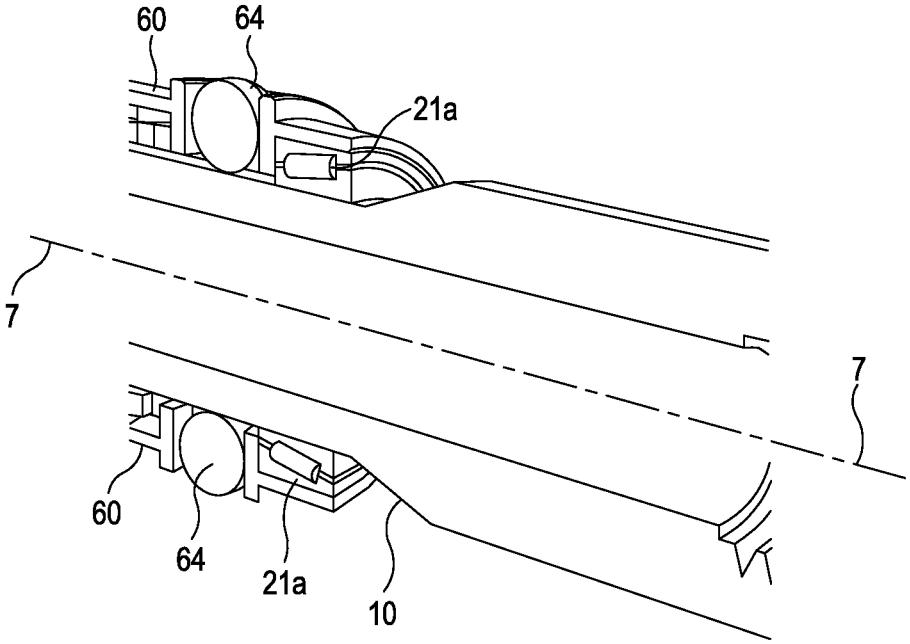
FIG. 6 is a perspective sectional representation of a first end portion of the vibration damping device of FIGS. 4 and 5, in larger scale.

The sleeve 60 is supported rotatably on the body 13 via thrust bearings 21*a*, 21*b* arranged near the first and second ends 61*a*, 61*b*, as seen in more detail in FIG. 6. The sleeve 60 also has roller wheels 64 which extend radially from an outer surface of the sleeve. The roller wheels 64 are spaced apart around a circumference of the sleeve 60 and arranged to be rotatable about axes tangentially along the circumference. In this way, the rollers 64 may roll to facilitate movement of the string in a longitudinal direction but may resist movement of the sleeve rotationally with respect to the wall of the wellbore when in contact with the wall of the wellbore.

Thus, the sleeve 60 is arranged on the drill string tubular 10 so that the drill string tubular 10 and sleeve 60 are rotatable one relative to the other. Thus, the drill string can be rotated in the wellbore about the longitudinal axis of the string by rotary equipment on a drilling rig at the surface. The sleeve 60 is arranged to be in frictional contact with a surrounding wall of the wellbore through the roller wheels 64. The roller wheels when in contact with the wellbore wall can hinder rotational slippage of the sleeve relative to the wellbore wall. This tends to result in the sleeve being retained rotationally, typically fixedly, in rotational position relative to the wall of the wellbore. The drill string tubular 10 is thus rotatable relative to the sleeve 60 about the longitudinal axis 7, on the bearings 21*a*, 21*b*.

Figure 7:
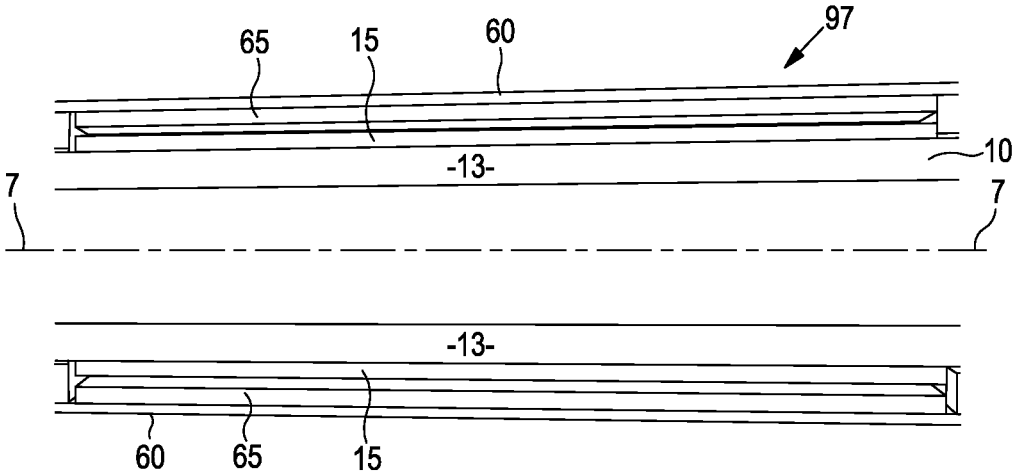
FIG. 7 is a side sectional representation of an intermediate portion of the vibration damping device of FIGS. 4 and 5, in larger scale.

To address rotational vibrations, the vibration damping device 100 has an intermediate damping section 97, seen in further detail in FIG. 7, which is generally configured to operate similarly to the device 200 above described with reference to FIGS. 1 to 3. In this intermediate damping section 97, the drill string tubular 10 has a surrounding sheath of non-magnetic, conductive material 15. The conductive material 15 comprises an integrated outer layer of the drill string tubular 10 that extends ring-wise circumferentially around the longitudinal axis 7. The outer sleeve 60 has a magnet ring 65 affixed to the sleeve 60. The portion of the tubular drill string tubular 10 with the conductive layer extends through the area enclosed by the magnet ring 65. Similar to the device of FIGS. 1 to 3 therefore, upon rotation of the drill string, the tubular body 13 with the applied conductive material 15 is rotatable about the longitudinal axis 7 relative to the magnet ring 65 of the surrounding sleeve 60. In the presence of the magnetic field in the area enclosed by the magnet ring 15, eddy currents are produced in the conductive material 15 of the layer, in dependence upon the rotational speed of the tubular body, and thus upon variations in rotational speed due to rotational vibrations, the generated eddy currents produce a braking force which counters the effect of the rotational vibration component.

To address longitudinal vibrations, the vibration damping device 100 of FIGS. 4 and 5 has two further damping sections 96, 98 which are mirror configurations of one another in respective end regions of the device 100. The damping section 96 is described further now with reference additionally to FIG. 8.

The outer sleeve 60 in the damping section 96 carries a magnet sleeve 75 that is located within and is rotatable with respect to the outer sleeve 60. The rotatable magnet sleeve 75 is supported on the outer sleeve 60 upon bearings 51. The bearings 51 facilitate to position and permit rotation of the magnet sleeve 75 with respect to the outer sleeve 60. The magnet sleeve 75 comprises a cylindrical body extending circumferentially around the drill string tubular 10. The magnet sleeve 75 is also therefore rotatable relationship with respect to the drill string tubular 10, such that the drill string tubular 10 is rotatable both with respect to the magnet sleeve 75 and outer sleeve 60 in drilling operations.

The magnet sleeve 75 is further arranged longitudinally spaced apart from the fixed magnet ring 65 of outer sleeve 60 in the intermediate section 97. That is, the fixed magnet ring 65 in this example is in an intermediate location extending axially along the device between the magnet sleeves 75 of the further damping sections 96, 98.

The outer sleeve 60 in the damping section 96 also has a cylindrical collar 68 affixed to the outer sleeve 60. The cylindrical collar 68 is arranged within and has a cylindrical body portion 68*p* that extends longitudinally along the drill string tubular 10. The magnet sleeve 75 is arranged in an annular region 69 between an outer surface of the tubular body portion 68*p* and an inner surface of the outer sleeve 60. The cylindrical collar 68, in particular the wall of the cylindrical body portion 68*p* facing outwardly toward the magnet sleeve 75 comprises non-magnetic, conductive material. The magnet sleeve 75 is configured as the magnet ring to comprise permanent dipole magnets arranged to produce a magnetic field in the area enclosed by the magnet sleeve 75. Upon rotation of the magnet sleeve 75 with respect to the sleeve 60 (and the collar 68), eddy currents are generated in the conductive material of the collar 68.

The roller wheels 64 are coupled to the magnet sleeve 75 through a gear arrangement 80. Longitudinal rolling movement of the roller wheels 64 is transferred through the gear arrangement 80 into rotational movement of the magnet sleeve 75 relative to the outer sleeve 60 and vice versa. Thus, longitudinal vibrations of the drill string produce variations in the longitudinal speed of movement of the roller wheels 64, and this is expressed as variations in the rotational movement of the magnet sleeve 75. Eddy currents consequently produced in the conductive collar 68 generate breaking forces to the magnet sleeve 75 which is translated through the gear arrangement to brake the longitudinal rolling movement of the wheels 64 thereby counteracting the vibration longitudinally.

Figure 8:
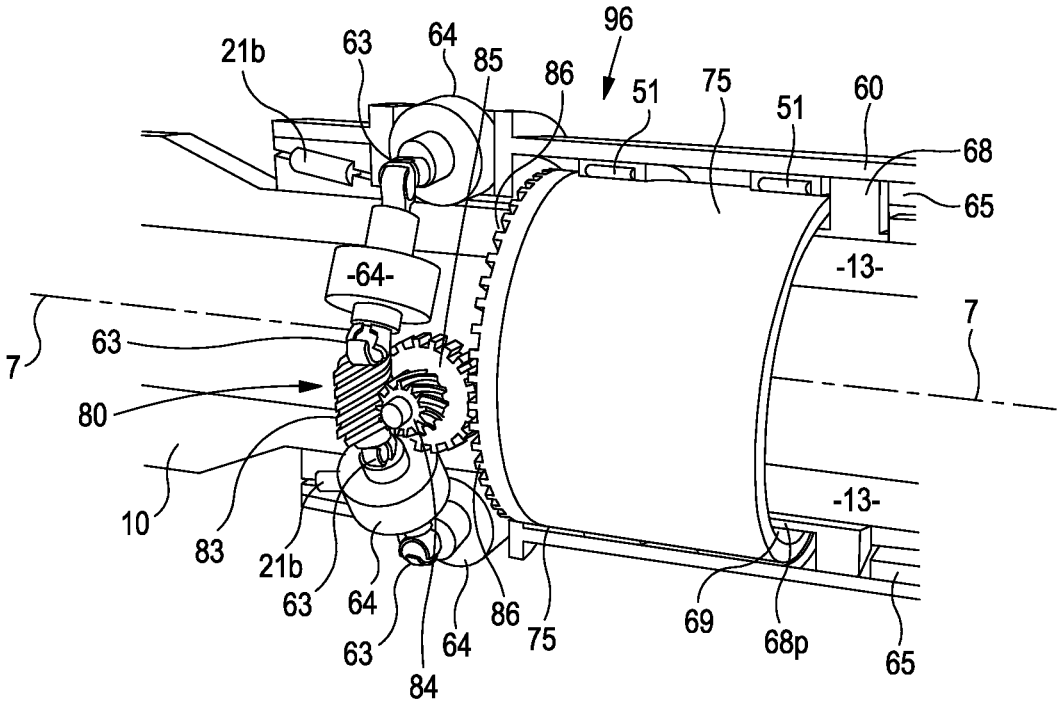
FIG. 8 is a perspective part sectional representation of a second end portion of the vibration damping device of FIGS. 4 and 5, in larger scale.
Figure 9:
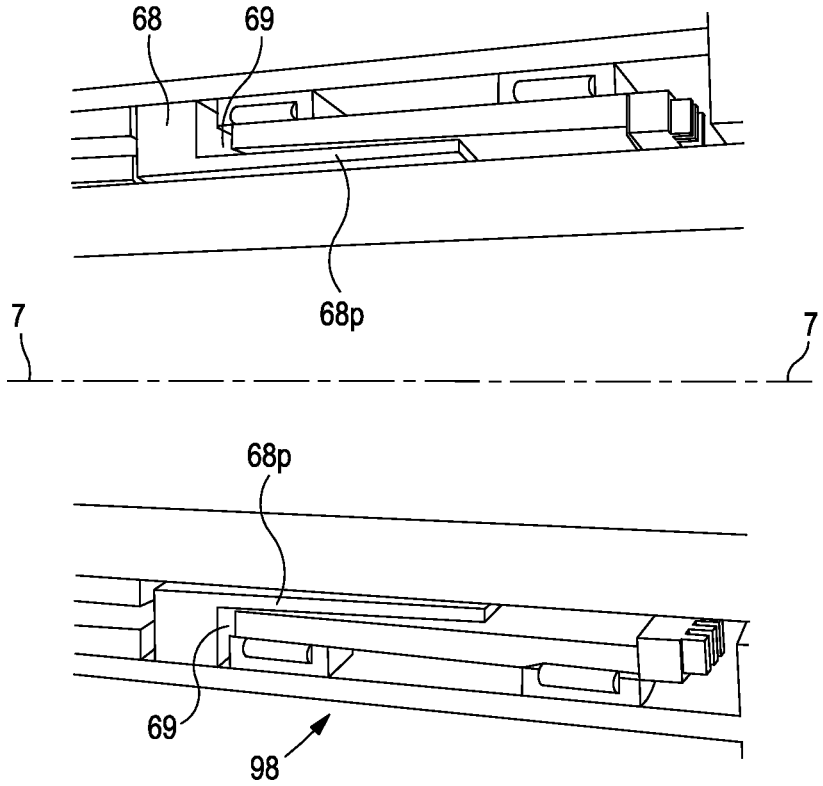
FIG. 9 is another sectional representation of a portion of the vibration damping device of FIGS. 4 and 5, near the first end and in larger scale.

As can be seen best in FIG. 8, the roller wheels 64 are daisy chained together through universal couplings between adjacent wheels 64. In this way, if only one of the wheels 64 happens to be in contact with the wellbore wall, then the rotation of the contacting wheel along the wellbore will result correspondingly in rotation of the coupled other wheels 64. The wheels 64 are daisy chained via the couplings around the circumference of the sleeve 60, which is facilitated by the universal couplings comprise bent joints between axles of the roller wheel 64 to wheels 64. The gear arrangement 80 in this example includes a worm gear 83 incorporated into the coupling 63 between one pair of the roller wheels 64. The worm gear 83 is generally cylindrical, having an end-to-end central axis about which the worm gear is rotatable. The worm gear 83 rotates with the rotation of the wheels 64.

The worm gear 83 in turn is coupled to the magnet sleeve 75 through first and second pinion gears 84, 85 rotating about a common, fixed axis perpendicular to the axis of the worm gear 83. The first pinion gear 84 intermeshes with the worm gear 83 and the second pinion gear 85, which is mounted on a common pin along coaxially with the first pinion gear 84, intermeshes with a tooth ring 86 along the circumference of one end of the magnet sleeve 75.

The turning of the worm gear 83, produces rotation of the first and second pinion gears 84, 85 and the rotation of the pinion gear 85 in engagement with the magnet sleeve 75 produces rotation of the magnet sleeve 75. Conversely, the gear arrangement 80 can operate in opposite sense so that rotation of the magnet sleeve 75 produces turning of the worm gear and the wheels 64. Rotation of the magnet sleeve 75 in a clockwise direction causes rotation of the wheels 64 in one direction, and rotation of the magnet sleeve 75 in an anticlockwise direction causes rotation of the wheels 64 in an opposite direction.

Thus, in the presence of longitudinal vibrations of the drill string during drilling as the drill string progresses and is advanced along the wellbore, the vibrational movement longitudinally is transmitted through the gear arrangement to the magnet sleeve 75 which produces eddy currents in the collar associated with the vibration which counteracts the vibration. Thus, longitudinal vibrations can be suppressed or reduced by the damping device 100 merely through the arrangement of mechanical components, in particular the sleeve, gear arrangement and magnet rings. Moreover, the longitudinal component of vibration can be suppressed or reduced independently of the rotational component of vibration. By incorporating the vibration damping device into the string, it can automatically act to attenuate the vibrations during the drilling process when the drill string is advanced into the well and rotated.

Although the device of FIGS. 4 to 9 provides for damping both rotational and longitudinal vibrations, the damping device in other variants can provide longitudinal only damping, for example where the intermediate portion for the rotational damping is omitted, and in other variants can provide rotational only damping, for example by omitting the coupling between the roller wheels to the brake parts.

In certain variants which provide rotational only damping, a device is configured as set out in relation to FIGS. 1 to 3 and further includes one or more roller wheels that support the device on the wellbore wall, and that permits rolling the device on the roller longitudinally along the wellbore and prevents rotational slippage of the sleeve and/or wheel relative to the wall when rotating the drill string and the tubular body within the sleeve. In FIG. 1, it can be appreciated that the sleeve is retained in position longitudinally with respect to the tubular body by suitable retainment means, and that the tubular body is rotatable within the outer sleeve with the rotation of the drill string. Other means than the thrust bearings could be used to support the sleeve on the tubular body. Also, the brake parts or brake means in some variants are not necessarily those arranged for eddy current or magnetic braking as described with reference to FIGS. 1 to 3. Such an arrangement using the roller wheel advantageously provides low friction on the string axially and separates rotational friction components from axial friction components whilst preventing slippage rotationally so that the rotational vibration components can be effectively braked or resisted by the brake means to damp the rotational vibration component.

The outer sleeve with roller wheels can extend outward from the drill sting tubular beyond width of the pipe collars so that the sleeve provides stand off for the string from the wall of the wellbore.

The damping device may be advantageous in various ways. For example, by way of the brake means operating in dependence upon the speed of motion of the string, the device may reduce vibrations of different magnitudes and characteristics and may reduce vibrations in different component directions of motion in accordance with the motion taking place at the time. The device may therefore damp a greater range of drill string vibrations than typical prior art solutions. Being a mere mechanical device operating passively, set up may be carried out more easily, requiring for example merely to insert the device into the string, without onerous "tuning". The device may operate to damp both torsional i.e. rotational and axial vibrations. The device may cope with vibrations that originate anywhere along the drill-string in contrast to prior art solutions which may only address bit-rock interaction excitations. In various embodiments, the damping device can be completely mechanical in design and therefore may be suitable to be used in very high temperature settings like for geothermal drilling. In contrast, to certain examples of prior art with an electronic-based control may be limited to temperatures that allow use electronic equipment. Energy consumption may be reduced everywhere there a vibration damping sub is provided in the string since the motion can be accommodated on bearings rather than sliding between two surfaces (mechanical friction).

Various modifications and improvements may be made without departing from the scope of the invention herein described.

The invention claimed is:

1. A device for damping vibrations of a rotary drill string in motion in a wellbore, the device comprising:

brake means to counter the vibrations, by way of resisting the motion in dependence upon the speed of motion, wherein the brake means comprises at least one pair of brake parts;

an inner, tubular body extending longitudinally between first and second ends, the first end being configured with a threaded section to screw connect the tubular body to a first adjacent section of a drill string, and the second end being configured with a threaded section to screw connect to a second adjacent section of the drill string, the tubular body thus being configured to rotate with the drill string;

an outer sleeve supported on the inner, tubular body, the tubular body being arranged rotatably within the outer sleeve; and at least one roller wheel for supporting the outer sleeve on a wall of the wellbore, the roller wheel being configured to facilitate longitudinal movement of the device along the wall and prevent rotational slipping of the outer sleeve relative to the wall upon rotation of the drill string;

wherein the outer sleeve is associated with a first brake part of the pair, and the inner, tubular body is associated with a second brake part of the pair, the second brake part being movable relative to the first brake part upon rotation of the tubular body relative to the outer sleeve;

wherein the pair of brake parts are operable, through the movement of the second brake part relative to the first brake part upon rotation of the tubular body relative to the outer sleeve with the drill string, to produce a braking force in dependence upon the speed of rotation of the inner, tubular body relative to the outer sleeve for braking or resisting rotational vibrations; and one of the first brake part or the second brake part comprising at least one magnet to produce a magnetic field, and the other of the first brake part or second brake part comprising non-magnetic, conductive material to be subjected to the magnetic field, so that upon relative movement between the brake parts, eddy currents are obtained in the non-magnetic, conductive material of the other part for resisting the movement.

2. The device as claimed in claim 1, wherein the second brake part associated with the inner, tubular body comprises non-magnetic, conductive material, and the first brake part assoicated with the outer sleeve comprises at least one magnet for producing a magnetic field so that upon relative rotation of the inner, tubular body relative to the outer sleeve, in use, eddy currents are produced in the non-magnetic, conductive material for braking or resisting a rotational component of movement between the inner, tubular body and the outer sleeve.

3. The device as claimed in claim 1, wherein the first brake part associated with the outer sleeve comprises non-magnetic, conductive material, and the second brake part associated with the inner, tubular body comprises at least one magnet for producing a magnetic field so that upon relative rotation of the inner, tubular body relative to the outer sleeve, in use, eddy currents are produced in the non-magnetic, conductive material for braking or resisting a rotational component of movement between the inner, tubular body and the outer sleeve.

4. The device as claimed in claim 1, wherein either or both of the brake parts comprise a ring or sleeve or annular member.

5. The device as claimed in claim 1, wherein the outer sleeve is supported on the inner, tubular body on bearings for facilitating rotation of the inner, tubular body with respect to the outer sleeve upon rotating the drill string in use.

6. The device as claimed in claim 1, further comprising at least one other pair of brake parts for braking or resisting a longitudinal component of movement of the device relative to the wellbore in use, wherein the pair of brake parts are for braking or resisting a rotational component of movement between the inner, tubular body and the outer sleeve.

7. The device as claimed in claim 6, wherein the other pair of brake parts for braking or resisting the longitudinal component and the pair of brake parts for braking or resisting the rotational component are operable to respond independently to longitudinal and rotational components of motion of the rotary drill string with respect to the wellbore.

8. The device as claimed in claim 6, wherein the pair of brake parts for braking or resisting the longitudinal component are disposed on the outer sleeve.

9. The device as claimed in claim 8, wherein the at least one roller wheel is coupled to at least one of the brake parts or the other pair so that the movement of the roller wheel on the wall of the wellbore in use longitudinally is communicated to produce movement between the brake parts of the other pair in dependence upon the movement of the rotary drill string along the wellbore.

10. The device as claimed in claim 9, wherein either or both brake parts of the other pair for braking or resisting the longitudinal movement along the wellbore comprises a ring, a body or a sleeve which is rotatable about an axis and is coupled to the roller wheel through a gear arrangement for converting the rotational movement between the brake parts to longitudinal tracking of the roller wheel along the wellbore or vice versa in dependence upon the longitudinal movement of the drill string with respect to the wall of the wellbore.

11. A rotary drill string including at least one device in accordance with claim 1, disposed on a downhole section of the drill string.

12. The rotary drill string as claimed in claim 11, including a plurality of devices disposed on the drill string for damping vibrations at different downhole positions along the drill string.

13. A method of drilling a borehole using a drill string in accordance with claim 11.

14. The device as claimed in claim 7, wherein the pair of brake parts for braking or resisting the longitudinal component are disposed on the outer sleeve.

15. A device for damping vibrations of a rotary drill string in motion in a wellbore, the device comprising:

brake means to counter the vibrations, by way of resisting the motion in dependence upon the speed of motion, wherein the brake means comprises at least one pair of brake parts;

an inner, tubular body extending longitudinally between first and second ends, the first end being configured with a threaded section to screw connect the tubular body to a first adjacent section of a drill string, and the second end being configured with a threaded section to screw connect to a second adjacent section of the drill string, the tubular body thus being configured to rotate with the drill string;

an outer sleeve supported on the inner, tubular body, the tubular body being arranged rotatably within the outer sleeve;

at least one roller wheel for supporting the outer sleeve on a wall of the wellbore, the roller wheel being configured to facilitate longitudinal movement of the device along the wall and prevent rotational slipping of the outer sleeve relative to the wall upon rotation of the drill string;

wherein the outer sleeve comprises an outer brake part of the pair, and the inner, tubular body comprises an inner brake part of the pair;

wherein the brake parts are operable, through relative movement between the outer brake part and the inner brake part upon rotation of the tubular body relative to the outer sleeve with the drill string, to produce a braking force in dependence upon the speed of rotation of the inner, tubular body relative to the outer sleeve for braking or resisting rotational vibrations; and the inner brake part comprising at least one magnet to produce a magnetic field, and the outer brake part comprising non-magnetic, conductive material to be subjected to the magnetic field, so that upon relative movement between the brake parts, eddy currents are obtained in the non-magnetic, conductive material of the other part for braking or resisting a rotational component of movement between the inner, tubular body and the outer sleeve.

16. The device as claimed in claim 15, wherein either or both of the brake parts comprise a ring or sleeve or annular member.

17. The device as claimed in claim 15, wherein the outer sleeve is supported on the inner, tubular body on bearings for facilitating rotation of the inner, tubular body with respect to the outer sleeve upon rotating the drill string in use.

18. The device as claimed in claim 15, further comprising at least one other pair of brake parts for braking or resisting a longitudinal component of movement of the device relative to the wellbore in use, wherein the pair of brake parts are for braking or resisting a rotational component of movement between the inner, tubular body and the outer sleeve.

19. The device as claimed in claim 18, wherein the other pair of brake parts for braking or resisting the longitudinal component and the pair of brake parts for braking or resisting the rotational component are operable to respond independently to longitudinal and rotational components of motion of the rotary drill string with respect to the wellbore.

20. The device as claimed in claim 18, wherein the pair of brake parts for braking or resisting the longitudinal component are disposed on the outer sleeve.

* * * * *